US005123271A

United States Patent [19]

Sofy et al.

[11] Patent Number: 5,123,271

[45] Date of Patent: Jun. 23, 1992

[54] METHOD FOR REMOVING WORKPART BLANKS FROM SHEET-METAL STRIP

[75] Inventors: Hugh M. Sofy, Bloomfield Hills; Dennis P. Farhat, Rochester Hills, both of Mich.

[73] Assignee: HMS Products Co., Troy, Mich.

[21] Appl. No.: 661,704

[22] Filed: Feb. 27, 1991

[51] Int. Cl.[5] ..... B21D 28/08; B21D 43/10

[52] U.S. Cl. ..... 72/336; 72/329; 72/405; 83/35; 83/50

[58] Field of Search ..... 72/405, 336, 329, 333, 72/326; 83/35, 50, 39–41, 255, 256, 277, 923

[56] References Cited

U.S. PATENT DOCUMENTS 3,496,753 2/1970 Gibbing ..... 72/336
3,760,623 9/1973 Hempelmann ..... 72/336
4,914,996 4/1990 Lavorel ..... 72/336
5,016,506 5/1991 Bulso ..... 83/35

FOREIGN PATENT DOCUMENTS 3402315 7/1984 Fed. Rep. of Germany ..... 83/50
1123017 9/1956 France ..... 83/40

*Primary Examiner*—Daniel C. Crane
*Attorney, Agent, or Firm*—Reising, Ethington, Barnard, Perry & Milton

[57] ABSTRACT

A method of blanking workparts includes advancing the strip 26, 126 in a zig-zag fashion to a stationary blanking station 14, 114 disposed along axis A from which successive workparts are blanked from the strip 26, 126 and transferred along the axis A to successive forming stations 16, 18, 20, 22 by a transfer mechanism 28.

15 Claims, 4 Drawing Sheets

METHOD FOR REMOVING WORKPART BLANKS FROM SHEET-METAL STRIP

BACKGROUND OF THE INVENTION

1. Field of the Invention

The subject invention relates generally to a method for forming finished workparts from a continuous strip of sheet-metal, and more particularly to an improved method for forming finished workparts utilizing a transfer die-type punch press machine.

2. Description of the Prior Art

Punch press operations are frequently used in manufacturing processes to form a sheet-metal workpart into a final workpart shape. It is often necessary to form the workpart into final shape using a series of successive forming operations. When the workpart is large and/or is to be formed into a complex shape, a transfer die-type punch press is typically employed having a series of successive forming stations disposed along an axial path along which individual disconnected workparts progress from one forming station to successive forming stations. After a part has been formed at one station, fingers of a transfer mechanism pick the part up and transfer it to successive forming stations for further forming until the desired final shape is achieved. It is well known in the sheet-metal forming industry to blank workparts from the sheet-metal strip in staggered, close-nested fashion to minimize material waste. Examples of such teachings are illustrated in the U.S. Pat. Nos. 745,505 to Lee, issued Dec. 1, 1903; 915,043 to Robinson, issued Mar. 9, 1909; 3,665,794 to Wiig, issued May 30, 1972; 3,785,231 to Lake, Jr. et al, issued Jan, 15, 1974; and 3,786,704 to Lachaussee et al, issued Jan. 22, 1974.

After the workparts are blanked from the strip in the above manner, the practice currently known in the industry is to transfer the blanked workparts from the blanking station to a separate punch press machine where they are positioned along the axial path of the punch press for further transfer from one forming station to the next by the transfer mechanism of the punch press.

SUMMARY OF THE INVENTION AND ADVANTAGES

The present invention provides a method of forming finished workparts from a continuous strip of sheet-metal and comprises the steps of; blanking a workpart from the continuous strip of sheet-metal at a blanking station along an axis, transferring the workpart from a blanking station to at least a first successive forming station along the axis, and further forming the workpart at the first forming station. The invention is characterized by sequentially moving the strip both along the axis and laterally of the axis to blank successive workparts from the strip along the axis at laterally staggered positions along the length of the strip to minimize material waste while simultaneously transferring previously severed workparts from the blanking station to the first forming station.

The present invention provides a method for blanking workparts from the strip in staggered fashion from the strip at a position along the axial path of a punch press for immediate transfer to successive forming stations along the axial path by the transfer mechanism of the punch press. This method has the advantages of reducing material waste, eliminating a transfer step in the forming operation by blanking the workparts along the axial path of the punch press, reducing the amount of equipment necessary to form a workpart, simplifying the workpart forming process, and significantly reducing the cost to produce such workparts.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT OF FIGS. 1-5

The subject invention relates to a method of forming finished workparts from a continuous strip of sheet-metal and is particularly well suited for use with a transfer die-type punch press in which workparts are transferred individually from one forming station to the next to achieve a final workpart shape.

Figure 1:
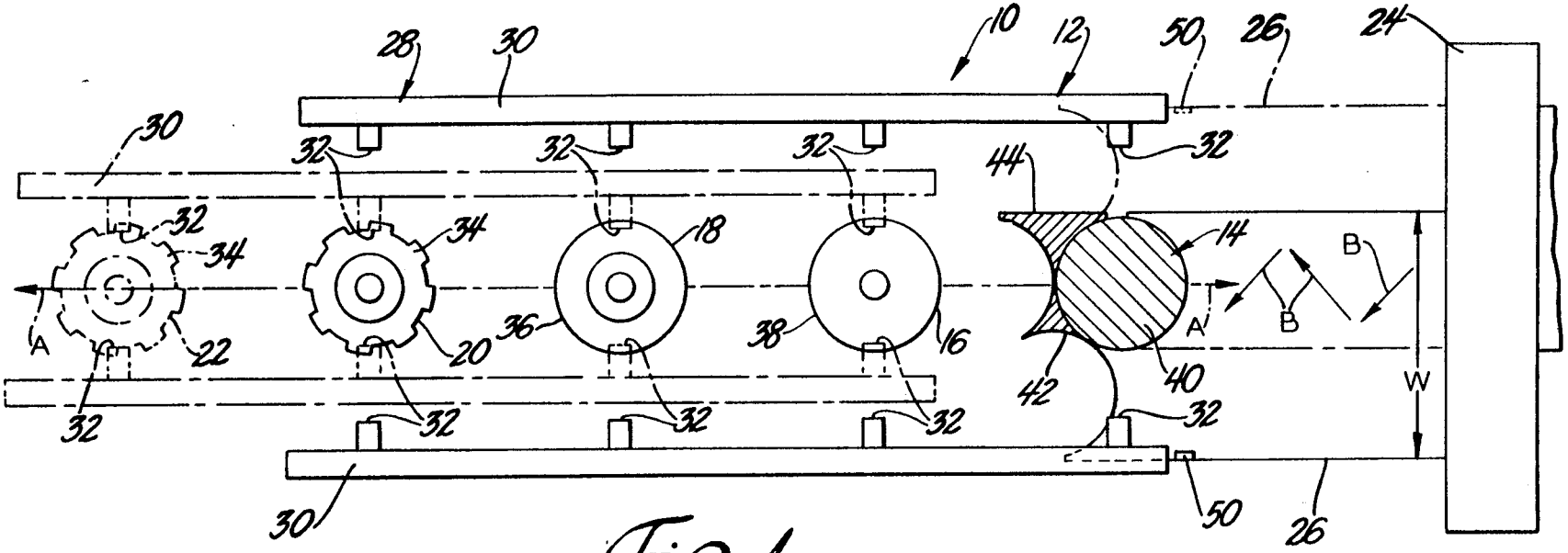
FIG. 1 is a schematic top view of the strip being advanced into a transfer die-type punch press provided with a transfer mechanism which is transferring workparts between the successive forming stations of the punch press.

Referring to the FIGS. 1-5, wherein like numerals are used to indicate the same or equivalent features throughout the several views, a sheet-metal forming apparatus is generally shown at 10. The apparatus 10 comprises a transfer die-type punch press 12 having a plurality of stations disposed in fixed positions along a central travel path or axis A of the punch press 12. The stations comprise a blanking station 14 having a blanking die (not shown) for blanking substantially circular workparts from a continuous strip of sheet-metal 26 having a predetermined width W, such as a coil of steel. The stations further include at least a first successive forming station 16 at which a forming operation is performed on the blanked workparts. Typically, a transfer die-type stamping press 12 includes several forming stations at which additional forming operations are performed on the workparts to achieve a desired final workpart shape. For illustrative purposes, the stamping press 12 of FIG. 1 is shown to include three such successive forming stations; a first forming station 16, a second forming station 18 and a third forming station 20. However, it is be appreciated that more or less forming stations could be employed. These forming stations 16, 18, 20, all lie along and define the central travel path or axis A of the stamping press 12 and are preferably spaced equal distances apart from one another.

The stamping press 12 also includes an unloading station 22 disposed along the central axis A of the stamping press 12 in sequence after the last forming station (i.e., the third forming station 20 of FIG. 1) at which the finished workparts are unloaded or removed from the stamping press 12.

The apparatus 10 includes a feeder mechanism 24 for advancing or feeding the continuous strip of sheet-metal 26 toward the stamping press 12 to position consecutive portions of the strip 26 at the blanking station 14 from which successive workparts are blanked from the strip 26 at the blanking station 14. The feeder mechanism 24 imparts planar movement to the strip 26 by incrementally moving the strip in a forward direction along the central axis A toward the stamping press 12 while simultaneously shifting the strip 26 laterally of the central axis A in oppositely alternating lateral directions as depicted by arrows B in FIG. 1. In other words, the strip 26 is sequentially moved both along the axis A and laterally of the axis A in an alternating zig-zag fashion to blank successive workparts from the strip 26 along the central axis A and from laterally staggered positions along the length of the strip 26. Blanking successive workparts in a closely nested, laterally staggered manner from the strip 26 minimizes material waste.

The stamping press 12 further includes a transfer mechanism 28 comprising a pair of transfer arms 30 disposed on opposite sides of the stations 14, 16, 18, 20, 22 and provided with cooperating pairs of workpart engaging fingers 32 extending from the transfer arms 30 inwardly toward the central axis A. The transfer arms 30 are moveably supported for lengthwise linear movement parallel to the central axis A a distance equal to the spacing between the stations 14, 16, 18, 20, 22 and for perpendicular lateral movement toward and away from the central axis A. The operation of the transfer mechanism 28 is fully described in U.S. Pat. No. 4,833,908 granted May 30, 1989 in the name of Hugh M. Sofy which is assigned to the assignee of the subject invention and incorporated herein by reference.

To form finished workparts from the continuous strip of sheet-metal 26, an initial portion of the strip 26 is positioned at the blanking station 14 and an initial circular workpart 34 is blanked (i.e., cut and disconnected) from the strip 26. As the workpart 34 is being blanked, the transfer arms 30 are positioned away from the central axis A in a home position shown in solid in FIG. 1 so as to not interfere with the blanking operation. Once the workpart 34 is blanked, the transfer arms 30 are extended inwardly from the initial home position toward the central axis A and a cooperating pair of workparting engaging fingers 32 engage the workpart 34. The transfer arms 30 are then moved forwardly (shown in phantom in FIG. 1) a distance equal to the spacing between the blanking station 14 and the first forming station 16 to transfer the workpart 34 from the blanking station 14 to the first forming station 16 along the central axis A of the stamping press 12.

The transfer operation of the transfer mechanism 28 is preferably synchronized with the feeding operation of the strip feeder mechanism 24 such that as a workpart (e.g., the initial workpart 34) is being transferred from the blanking station 14 to the first forming station 16, the feeder mechanism 24 is positioning a new successive portion of the strip 26 at the blanking station 14. That is, as a workpart is transferred from the blanking station 14 to the first forming station 16, the strip 26 is sequentially moved both along the axis A a predetermined axial distance X toward the stamping press 12 and laterally of the axis A a predetermined lateral distance Y.

Once the workpart 34 is transferred and the strip 26 is positioned, the transfer arms 30 are retracted away from the central axis A to disengage the workpart 34 and then moved back to the home position. After the workpart 34 has been disengaged, a forming operation is performed on the workpart 34 at the first forming station 16 while a first successive part 36 is blanked from the strip 26 at the blanking station 14 at a position along the length of the strip 26 laterally staggered from the position at which the initial blank 34 was blanked from the strip 26. After the first successive workpart 36 has been blanked and the initial workpart 34 formed, the transfer arms 30 are again extended toward the central axis A until the fingers 32 engage the workparts 34, 36. The arms 30 are then moved forwardly, transferring the workparts 34, 36 to the next consecutive forming station (i.e., the initial workpart 34 to the second forming station 18 and the first successive workpart 36 to the first forming station 16) while simultaneously advancing the strip 26 toward the stamping press 12 and positioning yet another next successive new portion of the strip 26 at the blanking station 14. A second successive workpart 38 is thereafter blanked from the strip 26 while the initial workpart 34 and the first successive workpart 36 are being formed at the second forming station 18 and first forming station 16 respectively.

The blanking of the second successive workpart 38 differs from the blanking of the first successive workpart 36 in that the strip 26 is shifted in an opposite lateral direction as the strip 6 is moved forwardly. That is, the strip 26 advances toward the stamping press 12 in an alternating zig-zag fashion, with each incremental forward movement of the strip 26 accompanied by a lateral movement in either one direction or the other in an alternating fashion with each forward movement such that successive workparts are blanked from the strip 26 in closely nested, alternating laterally staggered positions along the length of the strip 26 to minimize material waste. Thus, if the strip 26 is moved forward the distance X and shifted laterally in one direction a predetermined lateral distance Y to blank the first successive workpart 36, the strip 26 is thereafter moved forward the same distance X and shifted laterally in the opposite direction the same lateral distance Y to blank the second successive workpart 38.

To blank a third successive workpart 40, the strip 26 is advanced forward the same distance X and shifted laterally the same distance Y but opposite in direction as with the blanking of the second successive workpart 38. This alternating zig-zag movement of the strip 26 is repeated to continuously index the strip toward the stamping press 12 and position consecutive new portions of the strip 26 at the blanking station 14 to blank successive new parts from the leading edge of the strip 26 in the closely nested, laterally staggered manner described hereabove while simultaneously transferring previously blanked workparts from the blanking station 14 to the successive stations 16, 18, 20, 22 of the stamping press 12. FIG. 1 illustrates a stage in the forming process in which the third successive workpart 40 is being blanked at the blanking station 14, the second successive workpart 38 is being formed at the first forming station 16, the first successive workpart 36 is being formed at the second forming stations 18, and the initial workpart 34 is being formed at the third forming station 20, after which the workparts are transferred forwardly as depicted by the initial workpart 34 shown in phantom at the unloading station 22.

When employing the transfer mechanism 28 of the type disclosed in the present invention, it is important that the strip 26 not interfere with the transfer operation of the transfer mechanism 28. That is, since the workparts are disconnected from the strip 26 and are transferred from one station to the next by the transfer mechanism 28 and not carried along by remaining attached to the strip 26, the waste portions of the strip 26 remaining after each workpart is blanked must be discarded so as not to interfere with the engaging and transferring of the workparts by the transfer mechanism 28.

The method of the present invention discards the waste material of the strip 26 by disconnecting individual portions of waste material from the strip 26, from one another and from the associated workparts as the workparts are being blanked from the strip 26 at the blanking station 14. More particularly, the method comprises blanking the workparts from the strip 26 in a manner that leaves isolated islands or portions of generally triangular-shaped waste material 42, 44 disconnected centrally of the strip 26 and along the edges of the strip 26, respectively. The subject method disposes of the waste material 42, 44 by blanking workparts from the strip 26 in positions substantially tangent to either of the side edges of the strip 26 and substantially tangent to each of the next two successive workparts associated with each workpart blanked from the strip 26. That is, each workpart has a first common point of intersection with its associated first successive workpart and a second common point of intersection with its associated second successive workpart. In this manner, the waste material 42, 44 is cut and disconnected from the strip 26 at the blanking station 14 at the same time the workparts are being blanked from the strip 26. As each workpart is blanked from the strip 26 at the blanking station 14, the adjacent waste material 42, 44 associated with that workpart is simultaneously cut from the strip 26 and falls to the side out of the way of the transfer mechanism 28 permitting the transfer mechanism 28 unimpeded access to a given workpart.

In order to blank the workparts from the strip 26 while simultaneously scrapping the waste material 42, 44 in the above described manner, the width W of the strip 26 must be selected to accommodate the size of the circular workparts blanked from the strip 26 at the blanking station 14 and also assure that each workpart is substantially tangent to a side edge of the strip 26. The preferred dimensional relationship between the width W of the strip 26 and the size or radius R of the circular workparts is $W=2R\ (1+\cos 30)$. Thus, the width 10 of the strip 26 is dependent upon the radius R of the workparts to be blanked.

In addition to selecting the proper width W of the strip 26, the movement of the strip 26 must be precisely controlled to ensure that the workparts are blanked from the strip 26 at positions in which the edge of each workpart is substantially tangent to a side edge of the strip 26 and is substantially tangent to the positions at which the previously two workparts were blanked from the strip 26. To accomplish this, the strip 26 is moved forward an axial distance X generally equal to the radius of the circular workparts (i.e., $X=R$) and shifted laterally of the axis A in one or the other lateral direction a lateral distance Y generally equal to twice the radius R multiplied by the cosine of 30 (i.e., $Y=2R\cos 30$). Putting the above relationship in terms of the width W of the strip 26, the strip 26 is moved forward an axial distance X generally equal to the width W of the strip 26 divided by the quantity 2 times 1 plus the cosine of 30 (i.e., $X=W/2\ (1+\cos 30)$) and shifted laterally a lateral distance Y generally equal to the width W of the strip 26 times the cosine of 30 divided by the quantity 1 plus the cosine of 30 (i.e., $Y=W\cos 30/(1+\cos 30)$).

In the preferred method, the workparts are blanked from the strip 26 in a slight overlapping manner to assure that the scrap material 42, 44 is completely disconnected. To accomplish this, the movement of the strip 26 is slightly modified from that described above. In comparison to the movement described above the strip 26 is moved forward each time an axial distance X slightly less than the radius R of the circular workparts and shifted a lateral distance Y slightly less than 2R cos30. Specifically, the strip 26 is advanced forward toward the stamping press 12 an axial distance X equal to the radius R of each workpart minus 0.015 (i.e., $X=R-0.015$), were R is measured in inches, and simultaneously shifted a lateral distance Y equal to the quantity 2 times the radius multiplied by the cosine of 30 minus 0.008 (i.e., $2R\cos 30-0.008$). In this manner, the total combined distance Z the strip 26 is moved each time it is indexed toward the stamping press 12 to position a new consecutive portion of the strip 26 at the blanking station 14 (i.e., the center to center distance between positions at which successive workparts are blanked from the strip 26) is 2 times the radius minus 0.015 (i.e., $Z=2R-0.015$). By advancing the strip 26 in incremental amounts Z equal to 2R minus 0.015 inches in an alternating zig-zag fashion, each circular workpart overlaps the adjacent successive portions of the strip 26 thereafter blanked into the next two successive workparts by an amount equal to 0.015 inches such that as the two successive workparts associated with each workpart are blanked from the strip 26, the two successive workparts are left with concave cut-out portions 46.

Figure 5:
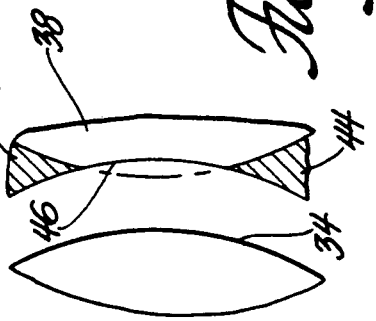
FIG. 5 is an enlarged fragmentary top view of the circumscribed portion 5 of FIG. 2.
Figure 2:
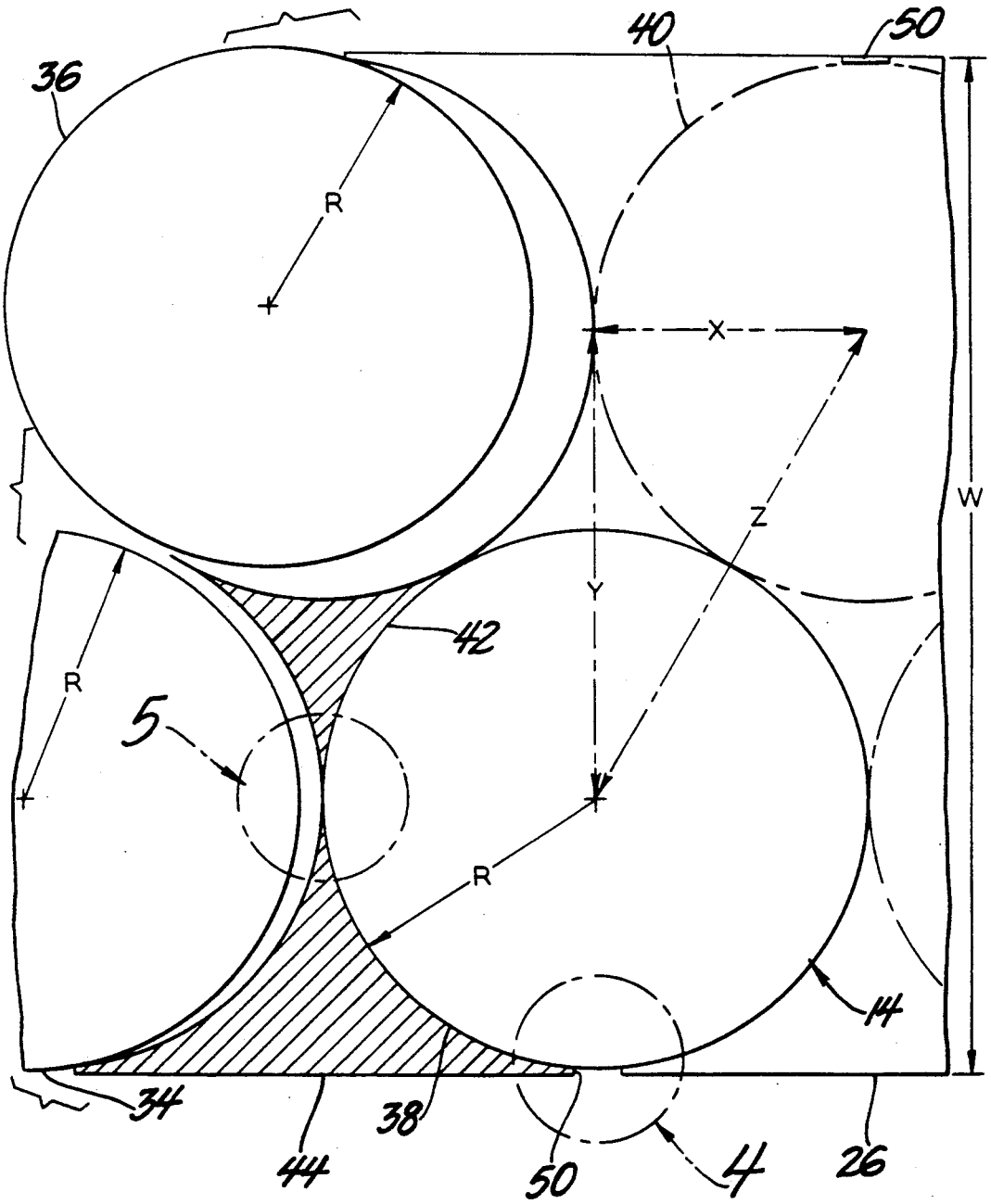
FIG. 2 is a top view of the sheet-metal strip with circular blanks being successively cut from the strip.

FIG. 5 shows an enlarged fragmentary view of the circumscribed portion 5 of FIG. 2 showing the initial workpart 34 having formed a concave cutout portion 46 in the second successive workpart 38 being blanked from the strip 26 at the blanking station 14. Thus, the workparts are blanked from the strip 26 with each workpart at least intersecting (and preferably slightly overlapping) each of the next two successive associated workparts.

The central islands of waste material 42 are formed between each workpart and each of the next two successive workparts. The islands of central waste material 42 have the appearance of equilateral triangles with concave sides formed by the blanking of the respective workparts. The slight overlapping of the workparts assures that adjacent central islands of waste material 42 are disconnected from the strip 26, from one another, and from adjacent islands of edge waste material 44. The edge waste material 44 has the shape of an isosceles triangle with the two congruent sides of each triangle being concave and formed by the blanking of a workpart and an associated second successive workpart with the remaining side of the triangle being substantially straight and formed by an adjacent side edge of the strip 26.

Notches 50 are cut into the side edges of the strip at positions along the length of the strip were the circular workparts are substantially tangent to the side edges of the strip 26. This assures that adjacent islands of edge waste material 44 are disconnected from one another in the event the blanking of the workparts is slightly misplaced from the desired positions along the strip 26 and thus not exactly tangent to the side edges of the strip 26 and in the event the width W of the strip 26 is slightly oversized. Preferably, the notches are cut from the side edges of the strip 26 before the workparts associated with each notch 50 are blanked from the strip 26.

In the preferred embodiment, the blanking station 14 is equipped with a pair of notching dies (not shown) disposed on opposite sides of a central axis A and spaced from one another along the axis A by an amount equal to the incremental axial displacement X of the strip (i.e., R−0.015) for cutting which cuts notches 50 from the strip 26 at predetermined regular spaced intervals (i.e., 2(R−0.01.5) along each side edge of the strip 26 as workparts are being blanked from the strip 26 at the blanking station 14. The notching dies (not shown) are positioned ahead of the blanking die (not shown) such that as a workpart is being blanked, the notch 50 associated with the next successive workpart to be blanked is being cut into the side edge of the strip 26. The notch 50 functions to remove a portion of the side edge waste material 44 prior to blanking the workpart from the strip associated with each notch 50 to ensure that adjacent portions of the side waste material 44 are disconnected from one another. Each notch 50 may extend far enough into the strip 26 so as to cut into or overlap the portion of the strip 26 subsequently blanked from the strip 26 into a workpart.

Figure 4:
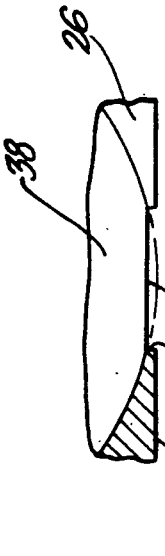
FIG. 4 is an enlarged fragmentary top view of the circumscribed portion 4 of FIG. 2.

FIG. 4 shows an enlarged fragmentary view of the circumscribed portion 4 of FIG. 2 showing a flat 52 formed on the second successive workpart 38 formed by the cutting of the notch 50. The flat 52 preferably extends approximately 0.015 inches into the workpart 38.

Figure 3:
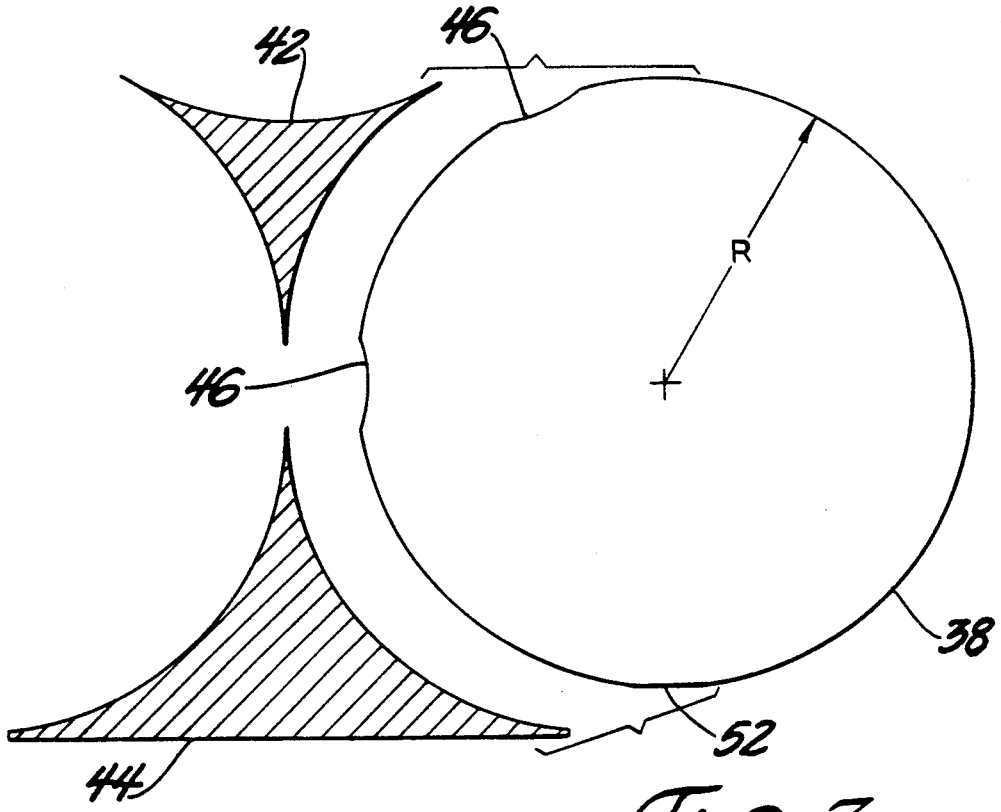
FIG. 3 is a top view of a workpart blanked from the strip leaving isolated islands of waste material disconnected from one another and from the workpart.

FIG. 3 shows the second successive workpart 38 of FIG. 2 blanked from the strip 26 at the blanking station 14 and shows the central 42 and side edge 44 islands of waste material disconnected (i.e., "scrapped") from the strip 26 and from one another simultaneously with the blanking the second successive workpart 38.

Thus, with the present invention, workparts are continuously blanked from the strip 26 in closely nested fashion to minimize material waste at a position along the central axis A of the stamping press 12 for immediate transfer by the transfer mechanism 28 of the stamping press 12 to the successive stations 16, 18, 20, 22 while at the same time the waste portions 42, 44 of the strip 26 are disconnected from the strip 26 and from one another to simultaneously "scrap" the waste material 42, 44 as the workparts are blanked to enable unencumbered access and transfer of the workparts by the transfer mechanism 28.

DESCRIPTION OF THE SECOND EMBODIMENT OF FIGS. 6 AND 7

Figure 6:
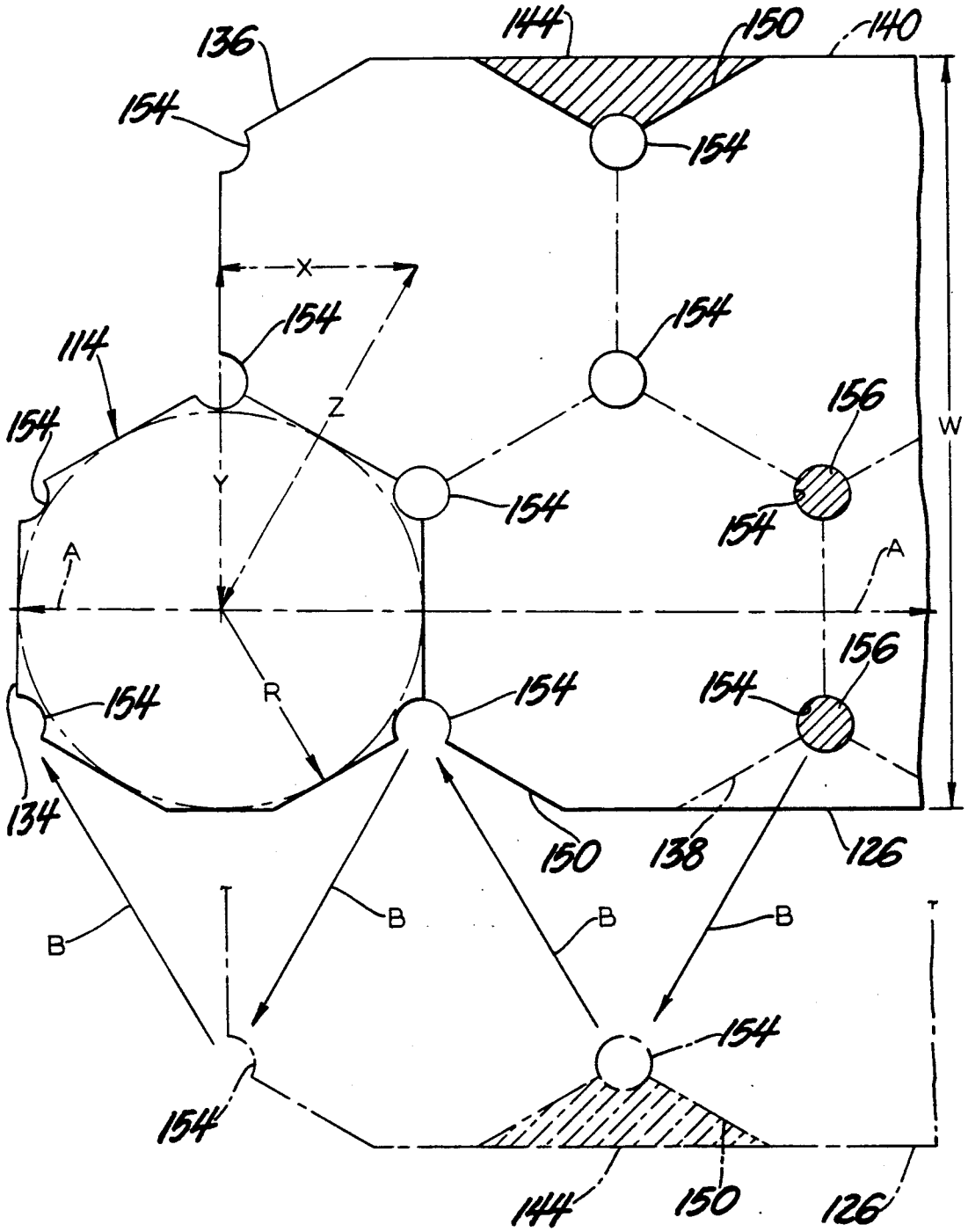
FIG. 6 is an alternative embodiment of the present invention showing a top view of a strip from which hexagonally-shaped blanks are being cut from the strip.
Figure 7:
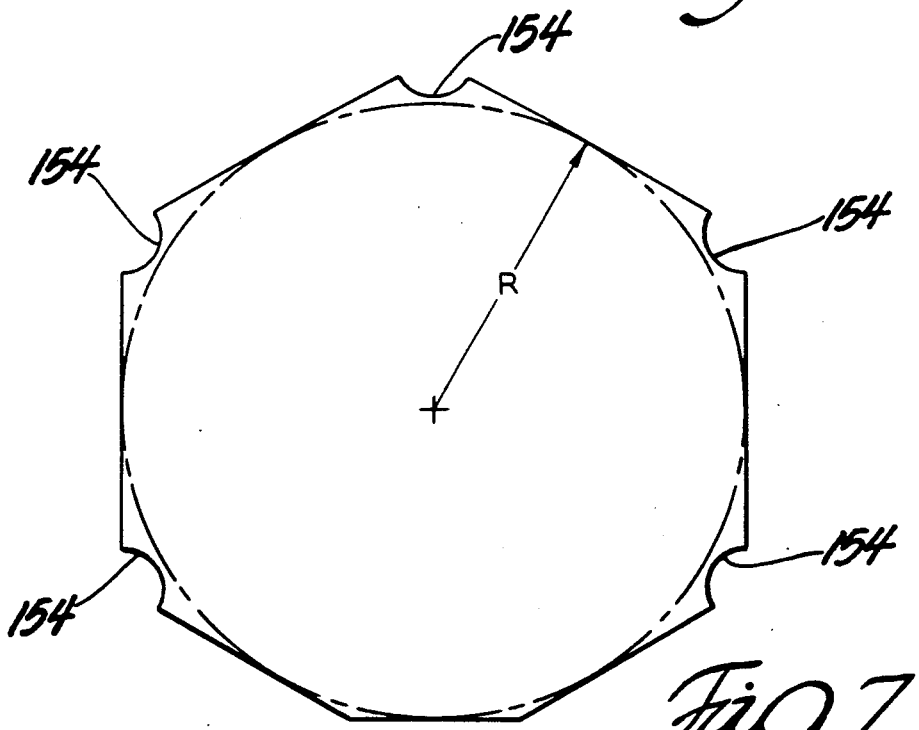
FIG. 7 is a top view of a hexagonally-shaped blank cut from the strip of FIG. 6.

An alternative method for practicing the present invention is illustrated in FIGS. 6 and 7 in which generally hexagonally-shaped workparts are blanked from the continuous strip of sheet-metal 126 at the blanking station 114. The alternative method is identical to the preferred method described hereinabove except as noted below.

In the alternative embodiment, successive workparts are blanked from the strip 126 in a closely nested, alternately staggered fashion along the length of the strip 126, like the preferred method, in order to minimize the material waste. Because of the hexagonal shape of the successive workparts of the alternative embodiment, the hexagonal workparts can be blanked from the strip 126 in an edge-to-edge manner with each workpart intersecting its associated first successive workpart along a first common line of intersection and intersecting its associated second successive workpart along a second common line of intersection. Thus, with this alternative method, there are no central waste portions formed or produced as with the preferred embodiment.

As with the preferred embodiment, the method of the alternative embodiment includes the step of advancing the strip 126 toward the stamping press in an alternating zig-zag fashion as depicted by arrows B of FIG. 6 to position the successive portions of the strip 126 at the blanking station 114 in order to blank the hexagonally workparts in closely nested, alternately staggered positions along the length of the strip 126 in the manner described above (i.e., with each workpart having sides tangent to each of the next two successively blanked workparts). To accomplish this, the strip 126 is moved both along the central axis A of the stamping press a predetermined axial distance X while at the same time shifting the strip 126 laterally of the axis A in either one lateral direction or the other a lateral distance Y to blank each successive workpart from the strip 126 in the preferred alternately staggered position. More particularly, each advancement of the strip 126 includes moving the strip forward an axial distance X equal to the radius R (i.e., X=R) of a circle inscribed in each of the hexagonal workparts (i.e., a circle having edges tangent to the edges of a hexagonal workpart-FIG. 7) while at the same time shifting the strip laterally of the axis A a lateral distance Y equal to 2 times the radius of the inscribed circle multiplied by the cosine of 30 (i.e., Y=2R cos30). The width W of the strip 126 is selected based on the size of the inscribed circle of the workparts. Specifically, the width W of the strip 126 is equal to twice the radius R of an inscribed circle times the quantity 1 plus the cosine of 30 (i.e., W=2R (1+cos30)). Thus, in terms of the width W of the strip 126, the strip 126 is moved an axial distance X equal to the width W of the strip 126 divided 2 times the quantity 1 plus the cosine of 30 (i.e., X=W/2(1+cos30)) and is shifted laterally a lateral distance Y equal to the width W of the strip 126 times the cosine of 30 divided by the quantity 1 plus the cosine of 30 (i.e., Y=W cos30/(1+cos30)) in order to blank successive workparts from the strip 126.

Because of the hexagonal configuration of the workparts, portions of side edge waste material 144 having a generally triangular configuration are formed along the side edges of the strip 126 between each workpart and the associated second successive blanked workpart. In the alternative embodiment, notches 150 are cut into the side edges of the strip to disconnect entire portions of waste material 144 at the same time workparts are being blanked from the strip 126 at the blanking station 114. Preferably, the notches 150 associated with a given workpart and its associated second successive workpart is notched from the strip 126 prior to blanking the workparts from the strip 126. In this manner, the blanking die (not shown) need only be provided with cutting edges along the 3 trailing edges of the die to completely severe the workparts from the strip 126.

The blanking station 114 is provided with notching dies (not shown) disposed on opposite sides of the central axis A in sequence before the blanking die (not shown) to cut the notches 150 into the side edges of the strip 126 at predetermined spaced intervals (i.e., 2R) along each side edge of the strip 126 each time the strip 126 is advanced toward the stamping press and the next successive workpart is blanked from the strip 126.

Referring to FIG. 6, an initial workpart 134 is shown positioned at the blanking station 114 and blanked from the strip 126 by the blanking die (not shown). Also shown in phantom in FIG. 6 are the first 136 and second 138 successive workparts and others which have yet to be blanked from the strip 126. A notch 150 has been cut into the side edge of the strip 126 between the initial workpart 134 and the second successive workpart 138 to remove the edge waste material (not shown) associated with the initial 134 and second successive 138 workparts. Also shown is a portion of side edge waste material 144 positioned between the first successive workpart 136 and a third successive workpart 140 which is being cut and disconnected from the strip 126 as the initial workpart 134 is being blanked from the strip 126. Thus, each time a workpart is being blanked from the strip 126, an entire portion of edge waste material 144 associated with the first and third successive workparts is being cut and disconnected from the strip 126.

The workparts are blanked from the strip 126 with each workpart overlapping an adjacent side edge of the strip 126 such that the adjacent side edge of the strip 126 is tangent to the circle inscribed in each workpart.

The alternative method also includes an additional operation of cutting relief holes 154 into the strip 126 at positions where the corners of adjacent hexagonal workparts meet. As can be seen in FIG. 6, the blanking station 114 is provided with a pair of relief hole punches 156 disposed on opposite sides of the central axis A ahead of the blanking die for cutting the relief holes 154 into the strip 126 at the same time workparts are being blanked from the strip 126. The relief holes 154 are cut from the strip 126 before the associated workparts are blanked from the strip 126 to prevent damage to the workparts as they are blanked from the strip 126.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method of forming finished workparts from a continuous strip of sheet-metal in a blanking station (14, 114) and forming station (16) both arranged along an axis (A), comprising the steps of;

feeding a continuous strip of sheet-metal (26, 126) to a blanking station (14, 114) disposed along the axis (A);

blanking a workpart from the strip of sheet-metal (26, 126) at the blanking station (14, 114) along the axis (A);

transferring the workpart by a transfer mechanism from the blanking station (14, 114) to at least a first successive forming station (16) along the axis (A);

further forming the workpart at the first forming station (16);

characterized by sequentially moving the strip (26, 126) both along the axis (A) and laterally of the axis (A) to blank successive workparts from the strip (26, 126) along the axis (A) at laterally staggered positions along the length of the strip (26, 126) to minimize material waste while simultaneously transferring previously blanked workparts from the blanking station (14, 114) to the first forming station (16) along the axis (A), the movement of the strip (26, 126) to the blanking station (14, 114) being different than the movement of the workparts from the blanking station (14, 114) to the forming station (16).

2. A method as set forth in claim 1 further characterized by blanking the workparts from the strip (26, 126) leaving isolated islands of waste material (42, 44, 144) disconnected from one another and from the workparts.

3. A method as set forth in claim 2 further characterized by blanking the workparts from the strip (26, 126) in tight nested fashion with each workpart having a first common point of intersection with a first successive workpart.

4. A method as set forth in claim 3 further characterized by blanking the workparts from the strip (26, 126) with each workpart having a second common point of intersection with a second successive workpart.

5. A method as set forth in claim 4 further characterized by moving the strip (26, 126) along the axis (A) while simultaneously shifting the strip (26, 126) laterally of the axis (A) in the plane of the strip (26, 126).

6. A method as set forth in claim 5 further characterized by cutting notches (50, 150) into side edges of the strip (26, 126) to disconnect at least a portion of the waste material (42, 44, 144) associated with each workpart from the strip (26, 126) prior to blanking each workpart from the strip (26, 126).

7. A method as set forth in claim 6 further characterized by cutting the notches (50, 150) at the blanking station (14, 114) while simultaneously blanking workparts.

8. A method as set forth in claim 7 further characterized by blanking intersecting circular workparts from the strip (26) at alternating laterally staggered positions along the length of the strip (26) leaving disconnected islands of generally triangular-shaped central waste material 42 between each workpart and the next two associated successive workparts.

9. A method as set forth in claim 8 further characterized by blanking circular workparts from the strip (26) with each workpart being generally tangent to an adjacent side edge of the strip (26) and intersecting one of the notches (50) formed in the adjacent side edge leaving a generally triangular-shaped island of edge waste material (44) between each workpart and its associated second successive workpart with the side edge of the strip (26) defining one edge of the island of waste material (44).

10. A method as set forth in claim 9 further characterized by sequentially moving the strip (26) along the axis a distance generally equal to $R-0.015$ while shifting the strip laterally of the axis a distance generally equal to $2R \cos 30-0.008$, where R equals the radius of each circular workpart measured in inches, to successively blank workparts from the strip (26).

11. A method as set forth in claim 7 further characterized by blanking generally hexagonally-shaped workparts from the strip (126) with each workpart having sides tangent to each of the next two successively blanked workparts.

12. A method as set forth in claim 11 further characterized by blanking the workparts from the strip (126) with each workpart overlapping an adjacent side edge of the strip (26) such that the adjacent edge of the strip (26) is tangent to a circle inscribed within each workpart.

13. A method as set forth in claim 12 further characterized by sequentially moving the strip (126) along the axis (A) distance generally equal to R while shifting the strip (126) laterally of the axis (A) distance generally equal to 2Rcos30, where R equals the radius of each circle inscribed within the workpart, to blank each successive workpart from the strip (126).

14. A method as set forth in claim 13 further characterized by cutting notches (150) into the side edges of the strip (126) to disconnect the entire portion of the edge waste material (144) associated with each workpart from the strip (126) prior to blanking each associated workpart from the strip (126).

15. A method for forming finished workparts from a continuous strip of sheet-metal in a blanking station (14, 114) and forming station (16) both arranged along an axis (A), comprising the steps of;

feeding a continuous strip of sheet metal (26, 126) having a predetermined width (W) to a blanking station (14, 114) disposed along the axis (A);

blanking a workpart from the strip (26, 126) at the blanking station (14, 114) along the axis (A);

transferring the workpart by a transfer mechanism from the blanking station (14, 114) to a successive forming station along the axis (A);

forming the workpart at the forming station;

characterized by moving the strip (26, 126) along the axis (A) a distance generally equal to W/2 (1+cos30) and shifting the strip (26, 126) laterally of the axis (A) in the plane of the strip (26, 126) a distance generally equal to Wcos30/(1+cos30) to blank successive workparts from the strip (26, 126) along the axis (A), the movement of the strip (26, 126) to the blanking station (14, 114) being different than the movement of the workparts from the blanking station (14, 114) to the forming station (16).

* * * * *